US007034703B2

(12) United States Patent
Morris

(10) Patent No.: US 7,034,703 B2
(45) Date of Patent: Apr. 25, 2006

(54) AMBIENT CONDITION DETECTOR WITH TIME DELAYED FUNCTION

(76) Inventor: Gary Jay Morris, 2026 Glenmark Ave., Morgantown, WV (US) 26505-2900

( * ) Notice: Subject to any disclaimer, the term of this patent is extended or adjusted under 35 U.S.C. 154(b) by 121 days.

(21) Appl. No.: 10/847,841

(22) Filed: May 18, 2004

(65) Prior Publication Data

US 2004/0246125 A1 Dec. 9, 2004

Related U.S. Application Data

(60) Provisional application No. 60/472,051, filed on May 20, 2003.

(51) Int. Cl.
*G08B 17/10* (2006.01)

(52) U.S. Cl. ..... 340/628; 340/629; 340/630; 340/632; 340/514; 340/515

(58) Field of Classification Search ..... 340/628, 340/629, 630, 632, 506, 507, 514, 515, 516, 340/577, 584, 531; 422/86, 94, 84; 73/23.21, 73/23.25

See application file for complete search history.

(56) References Cited

U.S. PATENT DOCUMENTS

| | | | | |
|---|---|---|---|---|
| 4,032,909 | A | 6/1977 | Boyce | |
| 4,688,021 | A | 8/1987 | Buck et al. | |
| 5,053,752 | A | 10/1991 | Epstien et al. | |
| 5,568,129 | A | 10/1996 | Sissleman | |
| 5,898,368 | A * | 4/1999 | Handley et al. | 340/514 |
| 6,078,269 | A * | 6/2000 | Markwell et al. | 340/825.5 |
| 6,348,871 | B1 | 2/2002 | Tanguay | |
| 6,600,424 | B1 | 7/2003 | Morris | |
| 6,624,750 | B1 * | 9/2003 | Marman et al. | 340/506 |
| 6,836,210 | B1 | 12/2004 | Tanguay | |
| 2004/0041703 | A1 * | 3/2004 | Bergman et al. | |

* cited by examiner

*Primary Examiner*—Hung Nguyen
(74) *Attorney, Agent, or Firm*—Gary J. Morris

(57) ABSTRACT

An ambient condition detector includes a time delay function whereby a user initiates a functionality test of the detector and has time to move away from the vicinity of the detector before a potentially hearing damaging, audible report is issued from the detector under test. Multiple ways to set the time delay interval are included in the various embodiments. The sensors of the ambient condition detector may include fire sensors, smoke sensors, gas sensors, motion sensors, vibration sensors and multiple combinations of these sensors.

26 Claims, 3 Drawing Sheets

AMBIENT CONDITION DETECTOR WITH TIME DELAYED FUNCTION

This application claims the benefit of Provisional Application 60/472,051 filed May 20, 2003.

BACKGROUND FOR THE INVENTION

1. Field of Invention

The present invention relates to an ambient condition detector which includes a time delay interval to permit the user to initiate a functionality test or status test of the detector and, subsequently, to allow the user to safely move to a remote location with respect to the detector under test such that the hearing of the user is protected from high sound level pressures issued by the detector in response to the desired test.

2. Background

Ambient condition detectors are extremely important safety devices to alert people of specific hazards that may occur in the surrounding environment. Examples of such hazards include the presence of fire, smoke, hazardous gases, motion, vibration, intrusion, etc. When at least one sensor in an ambient condition detector senses a hazardous parameter in the ambient environment, normally a loud audible warning is sounded. In the case where life and personal property may be at risk due to a sensed ambient condition, the audible warning is emitted with sufficient sound intensity to awaken a sleeping person. For example, one common sound intensity level used in residential smoke detection devices and carbon monoxide detection devices is 85 decibels at a distance of 10 feet from the output transducer.

One significant hazard associated with very loud audible warning tones or synthesized voice output emanating from ambient condition detectors is the possibility of damage to the human ear during routine testing of the devices. Even, if temporary or permanent loss of hearing of the user does not occur, at least many users experience physical discomfort when exposed to high intensity alarm sounds during routine testing of such devices. Manufacturers of many residential ambient condition detectors instruct the user to test the device weekly by depressing a test button on the detector until the audible alarm sounds and cycles though its prescribed duty cycle. The testing of such detectors inherently results in the user being within arm's length of the detector when the alarm sounds. The sound intensity level at this distance can well exceed 100 decibels, approaching or exceeding the threshold of pain for many users. Therefore, an improvement is needed to ambient condition detectors to reduce the high intensity sound exposure to the user during the manufacturer's recommended regular testing schedule for the device. It is particularly important to protect the user's hearing from regular exposure to very loud alarm sounds or synthesized verbal warnings since human hearing damage due to exposure to high intensity sound is known to be cumulative. Manufacturers of ambient condition detectors often include statements in the instruction manuals of the devices warning about potential hearing damage that may occur during operation of the alarm output in very close proximity to the user.

The present invention significantly improves the testing method of ambient condition detectors such that the user can initiate a functionality test of the detector and leave the immediate vicinity during a time delay prior to the loud test report. The user can clearly hear the audible test report at a distance, but without experiencing the high intensity sound in close proximity to the detector under test. With a reduced exposure to uncomfortably loud alarm output sounds, the user is more likely to routinely test ambient condition detectors in accordance with the manufacturer's recommendations, thereby increasing his or her safety.

SUMMARY OF THE INVENTION

The invention described herein comprises an ambient condition detector whereby the testing of the detector functionality by the user permits the user to be displaced from the detector much greater than an arm's length to protect the hearing of the user performing the test. The ambient condition detector includes a test button, other electrical switch device, or remote receiver of wireless signals (radio frequency, sound, light, etc.) to initiate a functionality test for the ambient condition detector. The present invention incorporates at least one time delay interval between the time a functionality test is initiated by the user and the time the audible test report is emitted so the user may move away from the detector being tested. By this means, the user can avoid the high intensity sounds emitted from the detector under test. Once the test button or switch is activated, visual or audio feedback is provided to the user to confirm that a functionality test has been successfully initiated and that the detector will audibly report after a prescribed time delay interval which is electronically or mechanically determined. In one embodiment of the invention, a light emitting diode (LED) is illuminated in a continuous or intermittent manner to indicate to the user that a functionality test has been initiated. For example, the user may depress the test button until an LED illuminates. The user may move away from the detector being tested or leave the vicinity or room completely to protect his or her hearing but still be able to determine if the test of the detector functionality was successfully completed.

In another embodiment of the invention, the user may initiate the test of the ambient condition detector by depressing the test button until an indicating LED illuminates (or other sensible feedback to the user) and the user remains pressing the test button for an amount of time that that is proportional to the delay time interval desired before the audible report output activates after the test button is released.

The prescribed time delay interval between user initiation of a functionality test and the subsequent audio report is defined in different ways in different embodiments. In one embodiment, the time delay is fixed and user-unalterable. In another embodiment, the user defines the time delay by activating a momentary switch for duration proportional to the delay time interval desired. In another embodiment, the user sets the time delay interval by repeatedly pressing the momentary switch, each time increasing the time delay by a fixed time increment. In another embodiment, the user defines a time delay interval by varying controls on the detector such as at least one variable resistor, at least one variable capacitor, at least one variable inductor, and at least one switch to activate at least one delay time interval different from the fixed delay time. In yet another embodiment, the user interfaces with a microprocessor to choose from a series of preset delay times stored in electronic memory. This interfacing with the microprocessor is by an electrical contact closure such as push button switch in a preferred embodiment.

DETAILED DESCRIPTION OF THE PREFERRED EMBODIMENT

Figure 1:
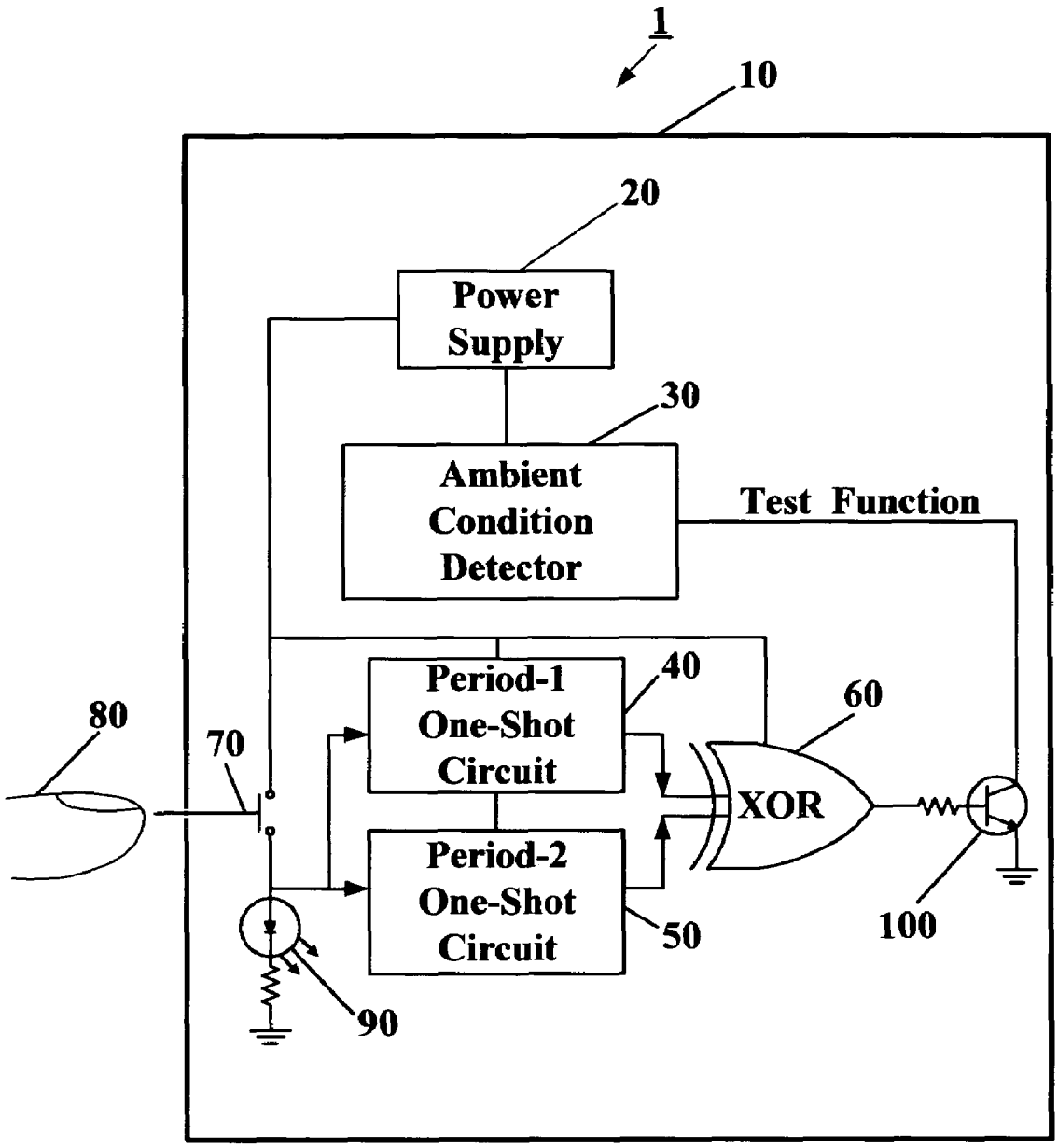
FIG. 1 is a block diagram of one preferred embodiment of the Ambient Condition Detector with Time Delayed Function using one-shot circuitry and digital logic.

While the embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Figure 2:
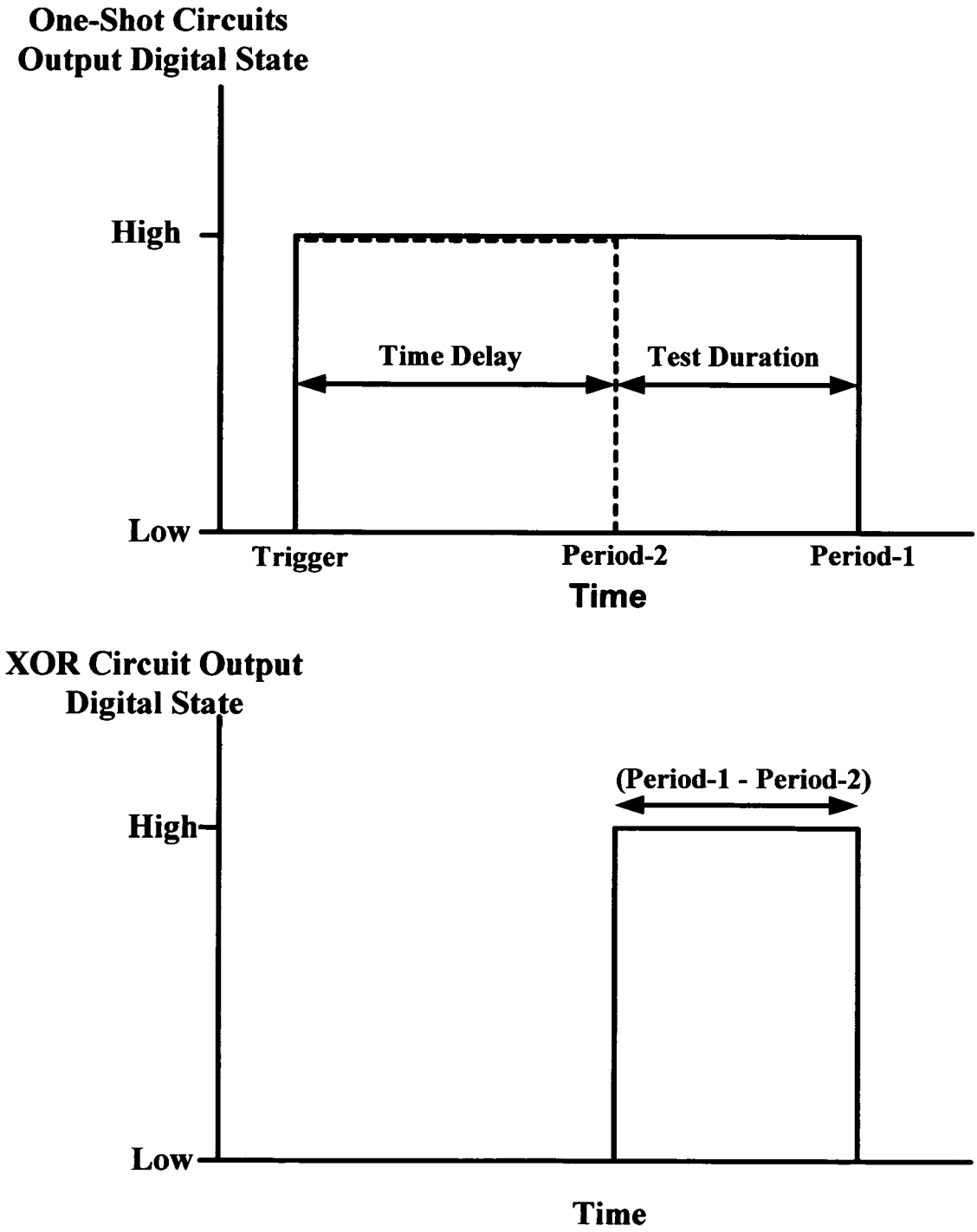
FIG. 2 is a timing diagram of the one-shot circuits and the exclusive OR logic circuit.

One of the preferred embodiments of the Ambient Condition Detector with Time Delayed Function 1 is shown in FIG. 1. The housing 10 encloses all of the other components of the device. The power supply 20 comprises a battery power supply or non-battery power supply with battery back-up. The power supply 20 is the source of electrical power for the ambient condition detector 30, the period-1 one-shot circuit 40, the period-2 one-shot circuit 50, and the exclusive OR logic gate 60. The period-1 one-shot circuit 40, the period-2 one-shot circuit 50, and the exclusive OR logic gate 60 are typically comprised of very low power consuming circuits, for example CMOS construction. The ambient condition detector 30 is comprised of at least one ambient condition sensor, control circuitry to operate ambient condition detector and at least one audio output transducer to emit at least one tonal pattern when an ambient condition is sensed. In one embodiment, the ambient condition detector 30, is further comprised of a plurality of sensors, each sensor is for a specific type of ambient condition such as fire, smoke, gas, motion, and vibration. One embodiment of the ambient condition detector 30 comprises a detector with a smoke sensor and a carbon monoxide sensor within the same housing 10. A user-operable, normally open, momentary switch 70 is a preferred user interface to initiate at least one test of the functionality of the ambient condition detector 30. Upon activation of the momentary switch 70, both the period-1 one-shot circuit 40 and the period-2 one-shot circuit 50 are simultaneously triggered and both outputs transition from a low to high state. The period of the high output state of the period-1 one-shot circuit 40 is longer than the period of the high output state of the period-2 one shot circuit 50 resulting in the output state of the exclusive OR gate 60 to transition from a low state to a high state for a duration equal to the difference between the periods of the high states of the period-1 one shot circuit 40 and period-2 one shot circuit 50. The transition from a low state to a high state at the output of the exclusive OR gate 60 activates transistor 100 or other electronic control device to activate at least one test of the functionality or component status of the ambient condition detector 30. The user 80, upon activating the momentary switch 70, can observe the illumination of the light emitting diode 90 as an indication that the momentary switch 70 has been activated to trigger the time delay. Alternatively in another embodiment, the light emitting diode 90 is activated by the output from the period-1 one shot circuit 40 or the output from the period-2 one-shot circuit 50 to indicate positive triggering of the one-shot circuits. Alternatively, in yet another embodiment, the user 80 may receive audible feedback instead of, or in addition to, visual feedback when the momentary switch 70 is activated. Since the one-shot circuit configurations in a preferred embodiment are non-retriggerable once triggered until the duty cycle is complete, there is no need to electronically debounce the momentary switch 70 although it is generally good practice to do so. After the user, 80 has activated the momentary switch 70, there is no further need for any user interface so the user 80 can move away from close proximity of the housing 10, while the delay timing is automatically controlled by the circuitry comprising the period-1 one-shot 40, the period-2 one shot 50, and the exclusive OR gate 60. When the period-2 one-shot 50 output transitions from a high state to a low state, at least one functionality test or status test of the ambient condition detector 30 is initiated. The test period continues until the period-1 one-shot 40 transitions from the high state to the low state. FIG. 2 illustrates the timing diagram and digital logic of the period-1 one-shot 40 and the period-2 one-shot 50 circuits and the exclusive OR gate 60.

In one illustrative embodiment, the period-1 one-shot 40 has a period of approximately 16 seconds and the period-2 one-shot 50 has a period of approximately 9 seconds resulting in an approximately 9 second delay until initiation of the test begins after the activation of momentary switch 70 is activated. The duration of the test would be approximately 7 seconds. This illustrative example is for clarification of operation and in no way limits the scope of the timing intervals of the time delay function. As another example, some time delay intervals could be on the order of two seconds or less.

In one embodiment, the functionality test of the ambient condition detector 30 is the activation of the audible alarm, tonal output. In another embodiment, the functionality test of the ambient condition detector 30 is the activation of verbal output to indicate the results of the functionality test. In yet another embodiment, the test of the ambient condition detector 30 is for an audible report of the condition of the power supply 20 which may contain at least one battery. In one embodiment, all of the audible outputs are emitted through at least one audio output transducer (not shown) as a component of the ambient condition detector 30.

Figure 3:
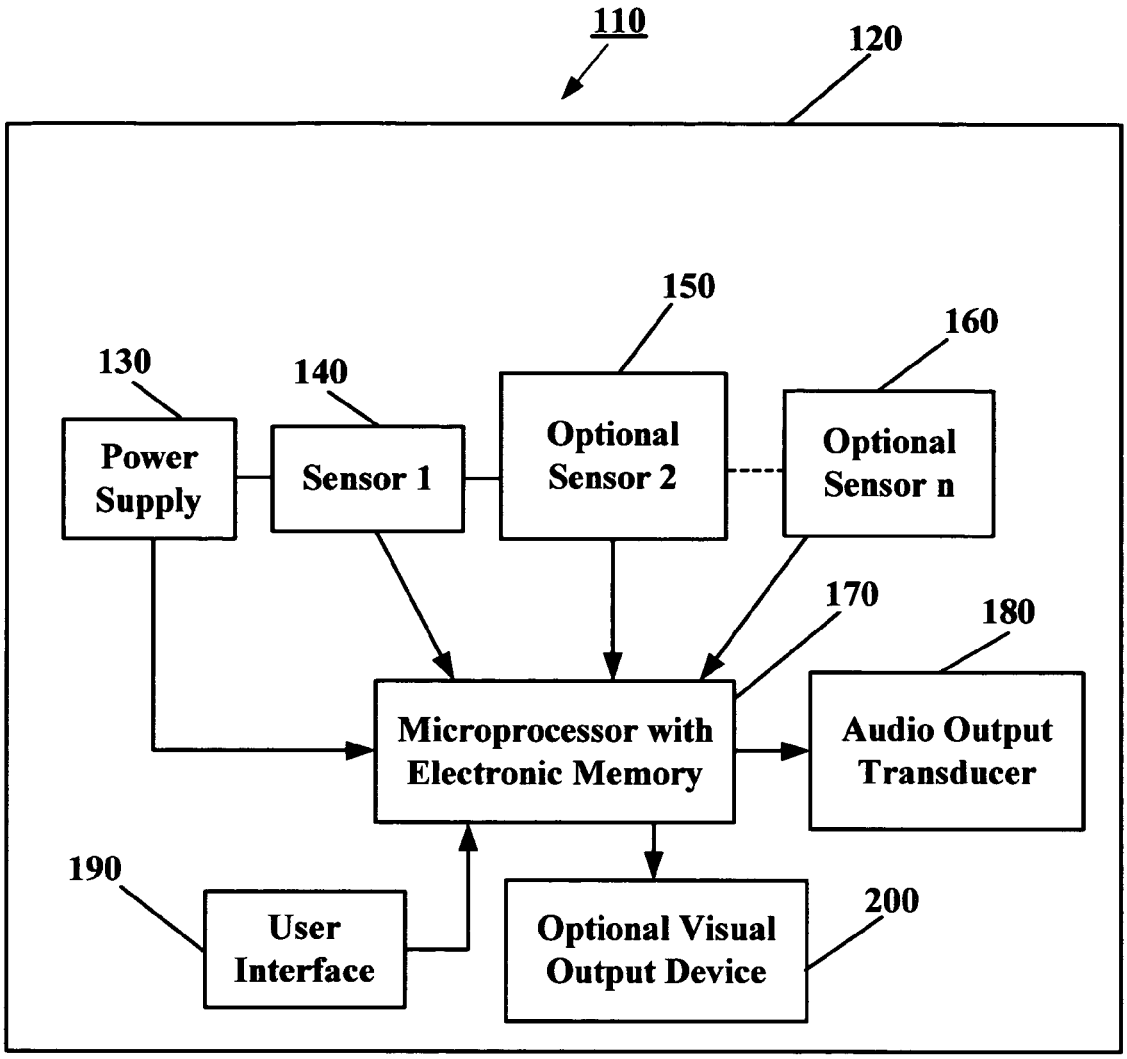
FIG. 3 is block diagram of another preferred embodiment of the Ambient Condition Detector with Time Delayed Function using microprocessor controlled circuitry.

A second preferred embodiment of the Ambient Condition Detector with Time Delayed Function 110 is shown in FIG. 3. The power supply 130 comprises a battery power supply or non-battery power supply with battery back-up and supplies electrical power to all electronic components within a common housing 120. The microprocessor with electronic memory circuit 170 controls and manages all major functions and logic decisions among the electronic components and has memory to at least define the output alarm pattern or a voice synthesized output in one embodiment. At least one ambient sensor 140 is interfaced with the microprocessor with electronic memory circuit 170. Alternatively, a plurality of ambient condition sensors (optional sensor 150 and optional sensor n 160, the integer, n, representing the total number of different ambient condition sensors greater than 2) is interfaced to the microprocessor with electronic memory circuit 170 to sense several different ambient conditions such as fire, smoke, gas, motion, and vibration. One embodiment of the invention including a plurality of sensors comprises a system with two ambient sensors, a smoke sensor and a carbon monoxide sensor within the common housing 120. Through the user interface 190 the user initiates the testing of at least one function of the Ambient Condition Detector with Time Delayed Function 110. One embodiment of the user interface 190 is a normally open, momentary switch or similar article. Upon activation of the user interface 190, the microprocessor with electronic memory circuit 170 delays the initiation of at least one functionality test or component status test of the Ambient Condition Detector with Time Delayed Function 110 having an audible report until a pre-programmed amount of time has transpired to permit the user to move away from close proximity of the system. Any visual output test reports can be immediately displayed without experiencing the time delay. The audible report of the test result is emitted through the audio output transducer 180 coupled to the microprocessor with electronic memory circuit 170. The audio output transducer also emits at least one tonal pattern upon the ambient sensor 140 sensing an ambient condition.

In another embodiment, the user activates the user interface 190 for a time proportional to the delay time interval desired until at least one functionality test or component test of the Ambient Condition Detector with Time Delayed Function 110 having an audible report is initiated. The microprocessor with electronic memory circuit 170 reads the duration of activation of the user interface 190 and waits a proportional amount of time before initiating at least one test of the Ambient Condition Detector with Time Delayed Function 110 having an audible report. Any visual output test reports can be immediately displayed without experiencing the time delay. The audible report of the test result is emitted through the audio output transducer 180 coupled to the microprocessor with electronic memory circuit 170. In another embodiment of the invention, the user activates the user interface 190, configured as a momentary switch, a plurality of times, each activation increases the time delay by a fixed increment. As an example, if the fixed time increment was 4 seconds as defined by the manufacturer, then activating the user interface 190 two times results in an 8 second time delay.

It is to be understood that the term "functionality test" used herein has broad meaning and represents an operational test of at least one electrical component of an ambient condition detector or the condition of a power source component therein. In one embodiment, the functionality test of the Ambient Condition Detector with Time Delayed Function 110 is the activation of the audible alarm output, as would be indicative of the sensed ambient condition(s). In yet another embodiment, the functionality test of the Ambient Condition Detector with Time Delayed Function 110 is for an audible report of the condition of the power supply 130. One embodiment includes at least one verbal message to indicate the status of the power supply, such as the battery voltage level.

It is understood that the time delayed function in all embodiments of the present invention also pertain to an immediate initiation of the functionality test when the user interface is activated with a time delay of the resulting audible report and still fall within the intended scope of the invention which is to provide time for the user to protect themselves from the high intensity sound report when a functionality test of an ambient condition detector is performed.

The various preferred embodiments described above are merely descriptive of the present invention and are in no way intended to limit the scope of the invention. Modification of the present invention will become obvious to those skilled in the art in light of the detailed description above, and such modifications are intended to fall within the scope of the appended claims.

It is to be understood that no limitation with respect to the specific apparatus illustrated herein is intended or should be inferred. It is of course, intended to cover by the appended claims all such modifications as fall with the scope of the claims.

I claim:

1. A detector comprising:

at least one sensor;

control circuitry coupled to the sensor;

an audio output device coupled to the control circuitry;

a momentarily activated user interface to initiate a time delay interval whereby, at the end of the time delay interval, at least one functionality test of the detector is executed;

a means to emit an audible report of the at least one functionality test;

a power source selected from a group including a battery, a non-battery power supply, and a non-battery power supply with a battery back-up;

a housing which contains the at least one sensor, the control circuitry, the user interface and the audio output device.

2. The detector as in claim 1, the time delay interval is user-unalterable.

3. The detector as in claim 1, the time delay interval defined by a user adjustable device selected from a group including a variable resistor, a variable capacitor, a variable inductor, and at least one electrical contact.

4. The detector as in claim 1, wherein the at least one functionality test is operability of the audio output device.

5. The detector as in claim 1, the control circuitry includes electronic circuitry to output a pre-recorded verbal message to report results of the at least one functionality test.

6. The detector as in claim 1, the user interface comprises at least one manually operated momentary electrical contact.

7. The detector as in claim 1, further comprises a visual output device to indicate when the time delay has been initiated.

8. The detector as in claim 1, further comprises an audible output to indicate when the time delay interval has been initiated.

9. The detector as in claim 1, further comprises at least one user sensible feedback when the user interface is activated.

10. The detector as in claim 1, the at least one sensor comprises an ambient condition sensor selected from a group including a smoke sensor, a fire sensor, a temperature sensor, a gas sensor, a vibration sensor, a motion sensor, and any multiple combination of these ambient condition sensor types.

11. The detector as in claim 1, the audible report indicates the charge condition of at least one battery powering at least one component in the detector.

12. An ambient condition detector with a time delayed functionality test report comprising:

an ambient condition sensor;

control circuitry coupled to the ambient condition sensor;

an audio output device coupled to the control circuitry;

a momentarily activated user interface to queue at least one functionality test of the detector;

time delay circuitry coupled to the control circuitry such that a time delay interval occurs between the queuing of the at least one functionality test and the initiation of the test;

a power source selected from a group including a battery, a non-battery power supply, and a non-battery power supply with a battery back-up;

a housing which contains the at least one sensor, the control circuitry, the user interface, and the audio output device.

13. The detector as in claim 12, wherein the user interface comprises at least one manually operated momentary electrical contact activated by a user.

14. The detector as in claim 12, wherein at least one duration of the time delay interval is proportional to a time period for which the momentarily activated user interface is activated by a user.

15. The detector as in claim 12, wherein at least one duration of the time delay interval is proportional to number of times the momentarily activated user is activated by a user.

16. The detector as in claim 12, wherein the audio output device comprises at least one audio transducer to emit a tonal pattern.

17. The detector as in claim 12, wherein the output device comprises at least one audio transducer to output a prerecorded verbal message reporting results of the at least one functionality test.

18. The detector as in claim 12, wherein the at least one sensor comprises a smoke sensor.

19. The detector as in claim 12, wherein the audible report indicates the charge condition of at least one battery powering any component in the detector.

20. An ambient condition detector comprising:

an ambient condition sensor;

control circuitry coupled to the ambient condition sensor;

an audio output transducer coupled to the control circuitry;

a user interface coupled to the control circuitry is momentarily activated by a user to initiate a time delay interval;

at the end of the time delay interval, the audio output transducer emits at least one audible output;

a power source selected from a group including a battery, a non-battery power supply, and a non-battery power supply with a battery back-up;

a housing which contains the at least one sensor, the control circuitry, the user interface, and the audio output transducer.

21. A method of operating an ambient condition detector comprising:

queuing, by a user, of at least one functionality test of at least one component of the ambient condition detector;

reporting, audibly, results of the at least one finality test;

delaying audible reporting of the result of the at least one functionality test for the duration of a time interval such that the time interval transpires between queuing of the at least one functionality test and audible reporting of the results of the at least one functionality test;

allowing the user to move away from the immediate vicinity of the detector after queuing of the at least one functionality test and prior to audible reporting of the results of the at least one functionality test.

22. The method of claim 21 wherein the time interval is on the order of at least 2 seconds.

23. An ambient condition detector apparatus comprising;

microprocessor controlled circuitry;

an audio output transducer coupled to the microprocessor controlled circuitry;

an ambient condition sensor coupled to the microprocessor controlled circuitry where upon sensing of an ambient condition by the ambient condition sensor the audio output transducer emits at least one audible tonal pattern;

a momentary electrical contact coupled to the microprocessor controlled circuitry, manual activation of the contact by a user queues at least one functionality test of the ambient condition detector;

sensible feedback to the user upon manual activation of the momentary electrical contact;

a time period of at least two seconds transpiring between manual activation of the momentary electrical contact and emission from the audio output transducer of an audible report of the at least one functionality test;

a housing containing at least the ambient condition sensor, the microprocessor controlled circuitry, the audio output transducer, and the momentary electrical contact.

24. The ambient condition detector apparatus of claim 23 wherein the sensible feedback further comprises at least one of an audible indication and a visual indication.

25. An ambient condition detector apparatus comprising;

electronic circuitry;

an audio output transducer coupled to the electronic circuitry;

an ambient condition sensor coupled to the electronic circuitry whereupon sensing of an ambient condition by the ambient condition sensor, the audio output transducer emits at least one audible tonal pattern;

a momentary switch, coupled to the electronic circuitry, whereby a user momentarily depresses and releases the switch to queue at least one functionality test of the ambient condition detector;

a time period of at least one second transpiring between queuing of the at least one functionality test and an emission from the audio output transducer of an audible report of the at least one functionality tests;

a housing containing at least the ambient condition sensor, the electronic circuitry, the audio output transducer, and the momentary switch.

26. The detector as in claim 25, the ambient condition sensor comprises a sensor selected from a group including a smoke sensor, a fire sensor, a temperature sensor, a gas sensor, a vibration sensor, and a motion sensor.

* * * * *

UNITED STATES PATENT AND TRADEMARK OFFICE

CERTIFICATE OF CORRECTION

PATENT NO. : 7,034,703 B2
APPLICATION NO. : 10/847841
DATED : April 25, 2006
INVENTOR(S) : Gary J. Morris It is certified that error appears in the above-identified patent and that said Letters Patent is hereby corrected as shown below:

In line 5 of Claim 21 (column 7, line 47) change “finality” to --functionality--

In line 16 of Claim 25 (column 8, line 45) change “tests” to --test--

Signed and Sealed this

Twelfth Day of December, 2006

JON W. DUDAS
*Director of the United States Patent and Trademark Office*